US006454026B1

(12) United States Patent
Shofner

(10) Patent No.: US 6,454,026 B1
(45) Date of Patent: Sep. 24, 2002

(54) PERCUSSIVE DOWN-THE-HOLE HAMMER FOR ROCK DRILLING, A TOP SUB USED THEREIN AND A METHOD FOR ADJUSTING AIR PRESSURE

(75) Inventor: Matthew Floyd Shofner, Alachua, FL (US)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/658,620

(22) Filed: Sep. 8, 2000

(51) Int. Cl.[7] ..... E21B 4/06
(52) U.S. Cl. ..... 175/296; 175/417; 173/91
(58) Field of Search ..... 175/414, 417, 175/420, 296; 173/17, 91, 115

(56) References Cited

U.S. PATENT DOCUMENTS 4,278,135 A 7/1981 Curington
5,722,495 A * 3/1998 Rear ..... 175/296
6,062,322 A 5/2000 Beccu et al. ..... 173/91
6,131,672 A * 10/2000 Beccu et al. ..... 173/91
6,209,666 B1 * 4/2001 Beccu et al. ..... 175/296

* cited by examiner

*Primary Examiner*—William Neuder
(74) *Attorney, Agent, or Firm*—Burns, Doane, Swecker & Mathis, LLP

(57) ABSTRACT

A down-the-hole percussive hammer includes a cylindrical casing adapted to carry a drill bit, and a piston mounted in the casing for reciprocal movement to repeatedly strike the drill bit. A top sub is mounted at a rear portion of the casing, the top sub including a front face facing the piston. A feed tube is mounted to the top sub and extends forwardly along a center axis of the casing and defines an air-conducting passage. The piston includes an axial through-hole which slidably receives the feed tube. The front face and the feed tube together define a recess opening toward the piston. A removable volume-changer is insertable into the recess to vary a volume of a space in which the piston slides, and thus control a pressure at which the piston operates.

15 Claims, 5 Drawing Sheets

PERCUSSIVE DOWN-THE-HOLE HAMMER FOR ROCK DRILLING, A TOP SUB USED THEREIN AND A METHOD FOR ADJUSTING AIR PRESSURE

TECHNICAL BACKGROUND

The present invention relates to a percussive down-the-hole hammer for rock drilling, and a method for adjusting air pressure.

DESCRIPTION OF THE PRIOR ART

A prior art drill bit for a down-the-hole (DTH) hammer is disclosed in Beccu et al. U.S. Pat. No. 6,062,322. The drill bit comprises an extended anvil portion on which a piston impacts repeatedly to advance the down-the-hole hammer through the rock. The problem that this invention addresses is one of maximizing DTH hammer performance for a given air compressor. In blasthole or deep hole applications, a drill rig will have an air compressor rated for a given air flow at a given maximum pressure. A DTH hammer acts like an orifice (i.e., a restriction) at the end of the drill string. The more air volume (cubic feet per minute) applied, the higher the operating pressure. If this orifice (hammer) is too big, the pressure will not build up high enough to operate at maximum efficiency. Conversely, if this orifice is too small, the compressor will overpressure and cause problems at the compressor. Since an air compressor is roughly 10 times the dollar value of a DTH hammer, it makes sense to design the hammer to the compressor size. There are many different compressor sizes on the market today. A few examples are listed below with the rated flow in cubic feet per minute followed by the rated pressure in pounds per square inch:

750/350

750/250

450/250

840/350

650/350

900/350

1000/350

1050/350

A current waterwell hammer as disclosed in U.S. Pat. No. 6,062,322 would hold approximately 350 psi (pounds per square inch) pressure with the 1050/350 compressor. It will hold approximately 340 psi with the 1000/1350 compressor. It will hold approximately 300 psi with the 900/350 compressor and approximately 280 psi with the 840/350 compressor. The ideal range to operate the hammer is in the 320 psi to 340 psi pressure range. If a compressor is delivering 900 cfm (cubic feet per minute), the pressure will never be in the ideal range for that kind of hammer. A simple and inexpensive adjustment needs to be made to allow the hammer to run at a higher pressure. There are a number of ways to increase or decrease the hammer air consumption for a given hammer.

1. Changing the orifice size that feeds the top chamber
2. Changing the top chamber size
3. Changing the piston stroke
4. Some combination of the above Prior hammers have used alternative No. 4 to decrease the air consumption on a low volume hammer by shortening the stroke, reducing the size of the top chamber, and restricting the orifice feeding the hammer. The problem there is one of cost. Sometimes the customer would have to buy a completely new hammer.

OBJECTS OF THE INVENTION

One object of the present invention is to provide an efficient down-the-hole hammer that is superior to prior art hammers.

Another object is to provide a down-the-hole hammer that allows simple and inexpensive adjustability.

Still another object is to provide an easy method to adjust the air pressure in a down-the-hole hammer to match the compressor output.

SUMMARY OF THE INVENTION

A first aspect of the present invention relates to a down-the-hole percussive drill for rock drilling. The drill comprises a generally cylindrical casing adapted to carry a drill bit. A piston is mounted in the casing for reciprocation in a longitudinal direction to repeatedly impart impacts to the drill bit. A hollow top sub is mounted at a rear portion of the casing. The top sub comprises a front face facing toward the piston. A hollow feed tube is mounted to the top sub and extends forwardly along a longitudinal center axis of the casing and defines a center passage adapted to conduct pressurized air. The piston includes an axial through-hole slidably receiving the feed tube, wherein the piston is slidable in a space disposed in front of the front face. The front face and the feed tube together form a recess which opens toward the piston. A volume-changer is removably insertable into the recess to vary a volume of the space and a pressure at which the piston operates.

Another aspect of the invention relates to the top sub per se.

Another aspect of the invention relates to a method of utilizing the above-described apparatus for varying a pressure at which the hammer operates.

BRIEF DESCRIPTION OF THE DRAWINGS

These and other objects of the present invention will become apparent from the following detailed description of preferred embodiments thereof in connection with the accompanying drawings, wherein.

DETAILED DESCRIPTION OF A PREFERRED EMBODIMENT OF THE INVENTION

Figure 1:
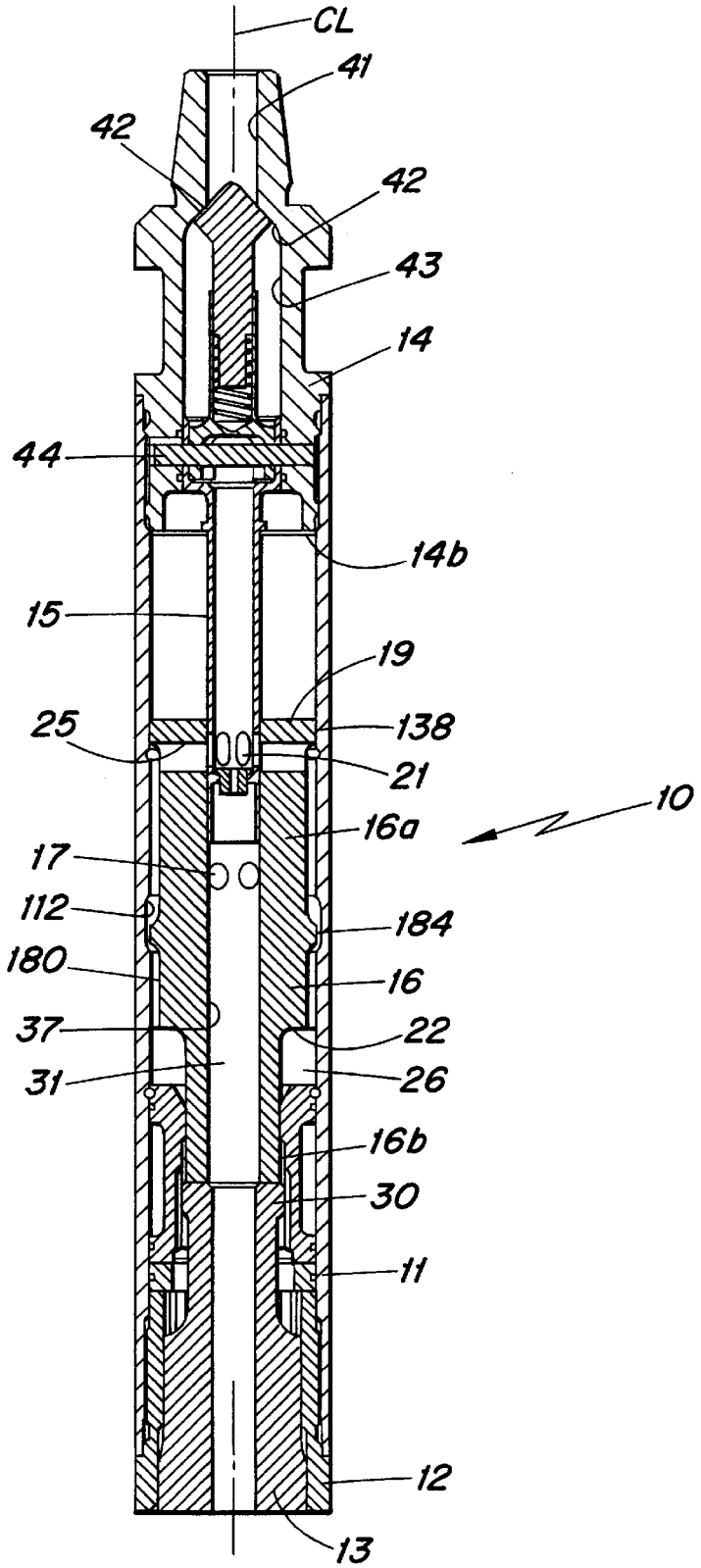
FIG. 1 shows a down-the-hole hammer according to the present invention in a longitudinal section.
Figure 2:
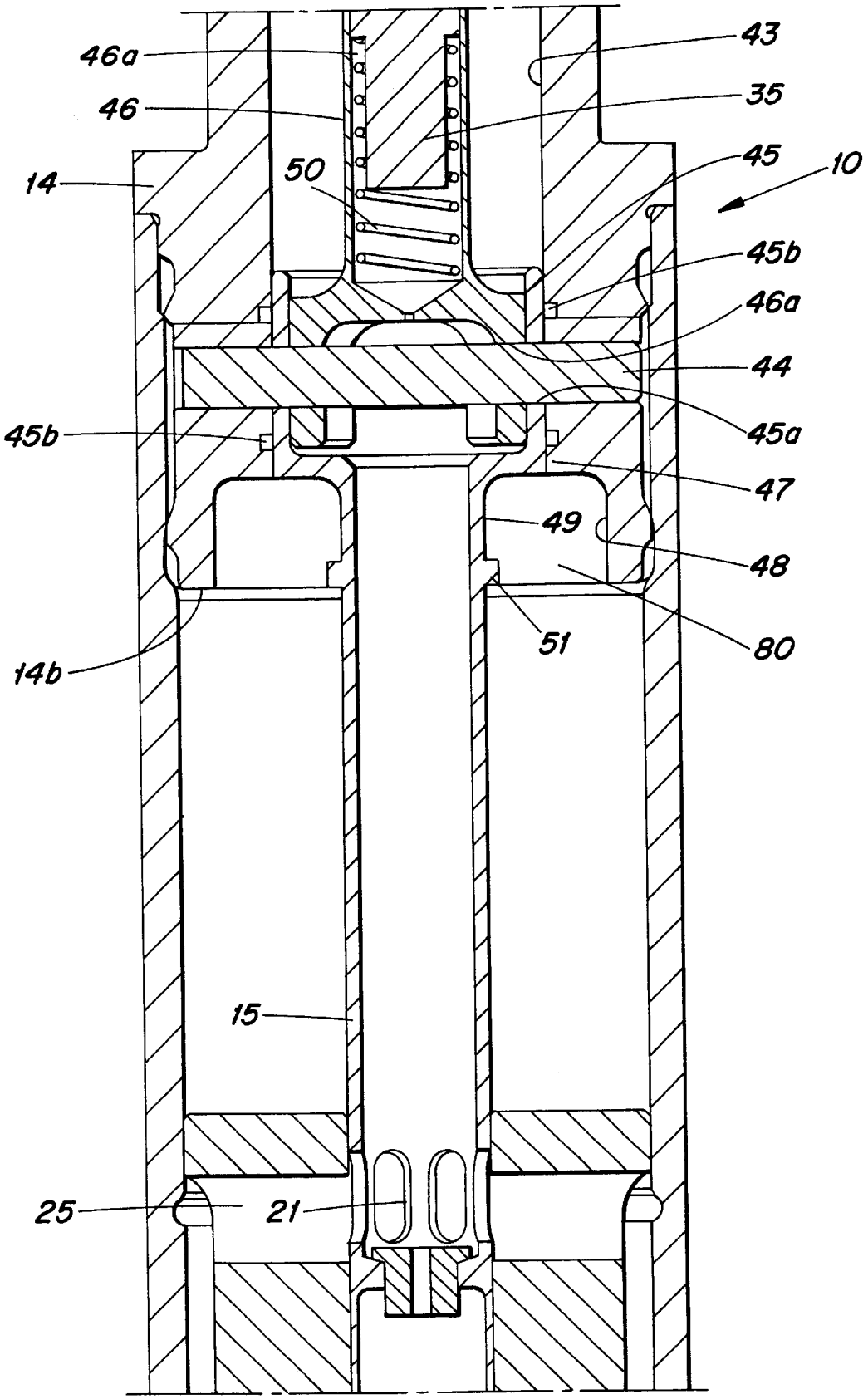
FIG. 2 shows an enlarged view from FIG. 1 in a high air consumption mode.

In FIGS. 1 and 2 there is shown a preferred embodiment of a down-the-hole hammer 10 according to the present invention. The hammer 10 comprises a reversible outer cylindrical casing 11 which, via a top sub 14, is connectable to a rotatable drill pipe string, not shown, through which compressed air is conducted. The top sub has an external screw thread 14*a* connected to the casing 11 and a front face 14*b*. The inner wall of the casing 11 has one air passage-defining groove 112. A hammer piston 16 reciprocates in the cylindrical casing 11, and compressed working air is directed alternately to the upper and lower ends of the piston to effect its reciprocation in the casing. Each downward stroke of the piston inflicts an impact blow upon the anvil portion 30 of a drill bit 13 (partly shown) mounted within a driver sub 12 at the lower portion of the cylindrical casing 11. The piston has a wide upper portion 16*a* and a narrow lower portion 16*b*.

The piston 16 includes a lower portion 16*b*, and an upper portion 16*a* that slidably engages the inner wall of the casing 11. Each of the portions 16*a* and 16*b* has a cylindrical basic shape and the lower, cylindrical portion 16*b* has a reduced diameter, thereby causing an intermediate end face or downwardly facing shoulder surface 22 to be formed on the upper portion 16*a* which surface is preferably perpendicular to the center line CL of the hammer. The construction of the piston is based on the idea that the mass distribution of the piston 16 is such that initially a smaller mass, i.e., the mass of the portion 16*b*, contacts the drill bit 13. Subsequently, a larger mass, i.e., the mass of the portion 16*a*, follows. It has turned out that by such an arrangement, much of the kinetic energy of the piston is transmitted into the rock via the drill bit as discussed in the copending U.S. patent application Ser. No. 09/503,343, the disclosure of which is hereby incorporated in the present description regarding the piston construction.

An inner cylindrical wall 37 of the piston defines a central passageway 31 and is arranged to slide upon a lower end of a coaxial control tube or feed tube 15 that is fastened to the top sub 14. The top sub and the feed tube together define a top sub assembly. The feed tube 15 is hollow and includes air inlets in a top end, and radial air outlet apertures 21 close to the lower end. The upper portion 16*a* of the piston is provided with several passageways for the transportation of pressurized air. A passageway 17 communicates with the upper end face 19 of the piston and opens into the wall 37 of the piston via a radial passageway at a location spaced along the length of the piston. A passageway 180 in the piston communicates with the shoulder 22 and is not spaced from the outer peripheral side surface of the piston. Rather, a longitudinal recess formed in the outer peripheral side surface 138 of the piston defines each of the second passageways 180. Thus, there are two such recesses 180 arranged diagonally opposite one another. An upper end of each recess 180 is spaced downwardly from the upwardly facing surface 19. Each recess is formed by a secant extending through the outer side surface 138.

Disposed between upper and lower ends of recesses 180 is a radially outwardly projecting rib 184 that includes an outer face which constitutes a continuation of the cylindrical outer surface of the piston.

The casing 11 has an annular groove 112 formed in an inner surface 114 thereof. The groove 112 is arranged to become aligned with the rib 184 when the air outlet apertures 21 of the feed tube 15 are aligned with passageways 25, whereby air is able to flow around the rib 184 and reach the bottom chamber 26.

The pressurized air is constantly delivered to a central bore 41 of the top sub while the hammer is in use. The bore 41 connects to a conical valve seat 42 that in turn connects to an expanded center cavity 43 of the top sub 14. The feed tube 15 extends into the center cavity 43 of the top sub 14. An enlarged portion 45 at the upper end of the control tube 15 is provided to mount the feed tube within the cavity. The cavity 43 includes annular grooves 45*b* in an inner surface thereof (see FIG. 4) for receiving O-ring seals which form a seal against the outer periphery of the portion 45.

The feed tube is mounted to the top sub by means of a lateral pin 44, extending through an aligned radial bore formed in the lower threaded portion of the top sub, a check valve guide 46 and the upper portion 45 of the tube 15. Bores 45*a* and 46*a* are formed in the feed tube 15 and the guide 46, respectively. The pin 44 extends diametrically all the way through the top sub 14. The upper portion of the tube 15 carries a check valve 35 which is resiliently arranged in the check valve guide 46 by means of a coil compression spring 50 (see FIG. 2) which biases the valve closed during periods when the apertures 21 of the feed tube 15 are blocked by the inner wall 37 of the piston 16.

The center cavity 43 connects via a shoulder 47 to a widened portion 48 of larger diameter than the cavity 43. The portion 48 is preferably of cylindrical shape. A substantially cylindrical neck portion 49 is formed adjacent to the enlarged portion 45. The feed tube 15 is provided with an annular rib 51 in the vicinity of the neck portion 49. A lower face of the rib 51 is coplanar with the front face 14*b*. The rib 51 may alternatively be positioned anywhere on the feed tube as long as it does not interfere with the piston stroke. The portion 48, the shoulder 47, the neck portion 49 and the rib 51 define a recess 80 in the top sub to allow a greater volume of air above the piston.

Figure 3:
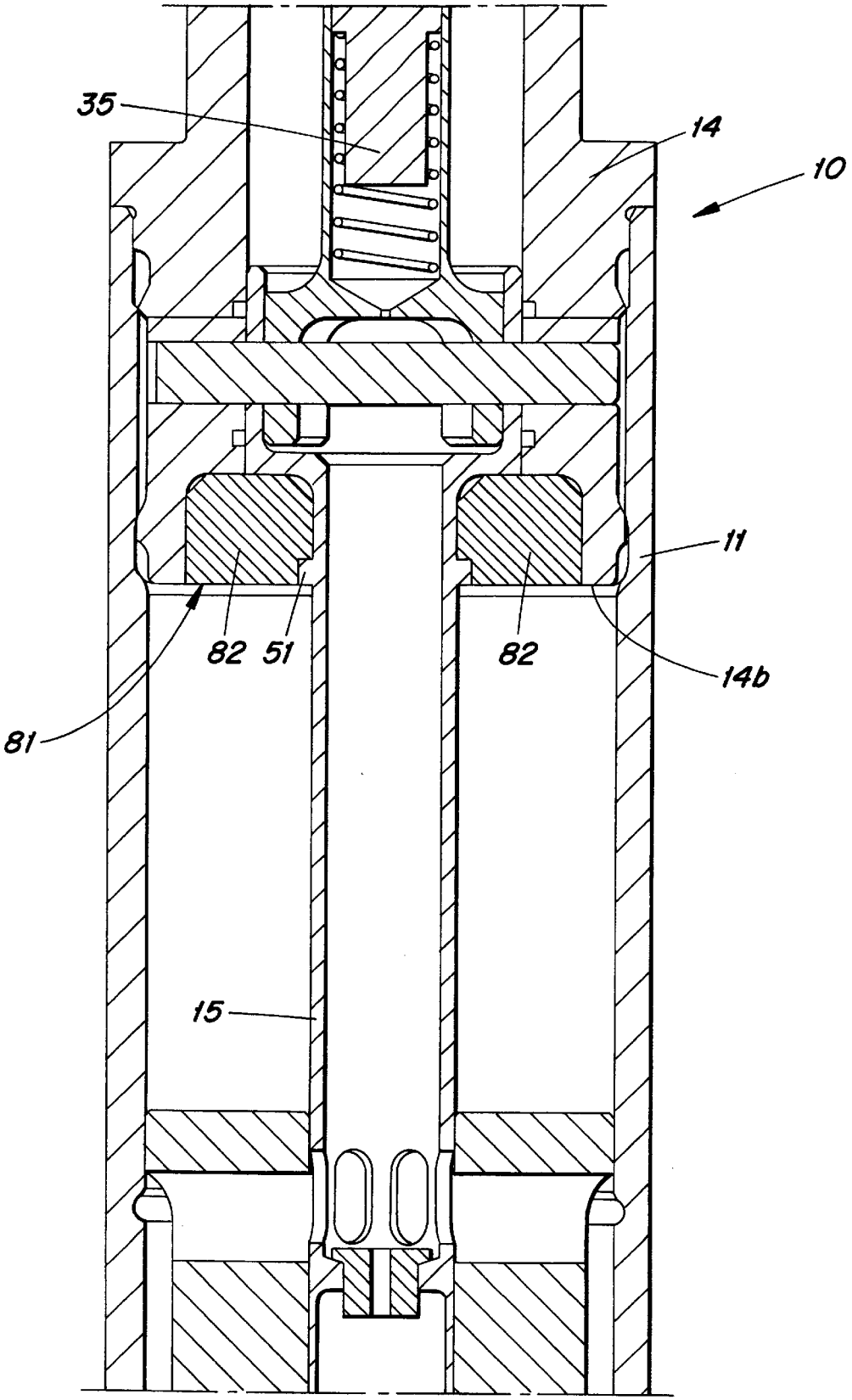
FIG. 3 shows a view similar to FIG. 2 but in an intermediate air consumption mode.
Figure 5:
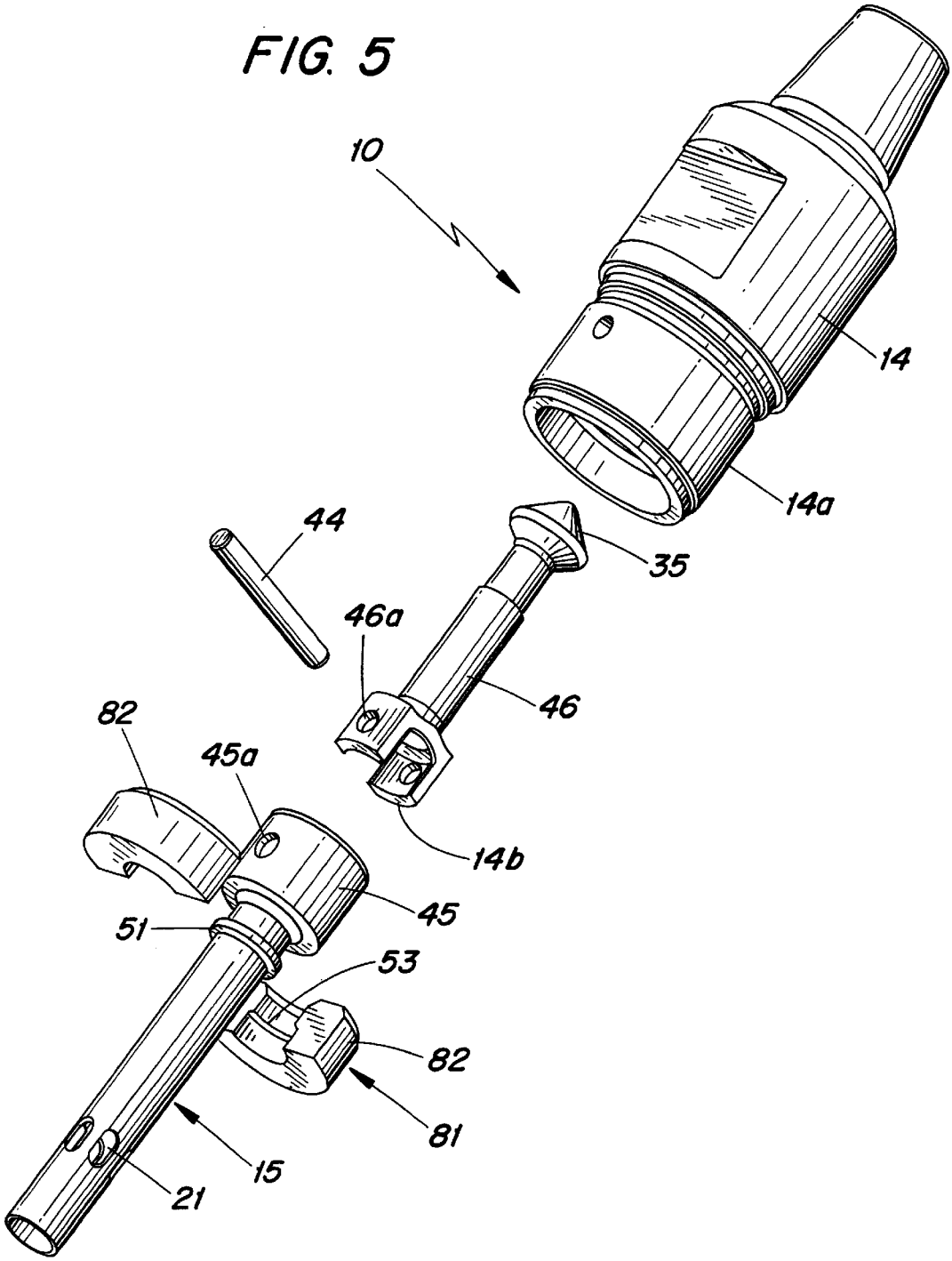
FIG. 5 shows some hammer parts in an exploded view.

The recess 80 may receive a volume-changer 81 comprised of one or more ring pieces 82 (see FIGS. 3 and 5). The volume-changer is preferably made in one piece and then split after finish machining to form two halves 82. The two halves are installed on the feed tube 15 in the recess 80 before the feed tube 15 is installed in the top sub 14. Once the feed tube is installed in the top sub 14, so that slits 83 formed in the halves 82 receive the rib 51 of the feed tube, the volume-changer 81 is locked in place by the internal diameter of the top sub cavity 43 interfering with any effort on the volume-changer halves from separating. Further, the rib 51 on the feed tube stops the volume-changer from interfering with the piston movements.

If the recess 80 is empty, the hammer is set to run efficiently with a 1050/350 or a 1000/350 air compressor. If the recess is filled up with a volume-changer 81 (see FIG. 3), this will lower the amount of air the hammer will use, thus increasing the air pressure. If the recess is filled with a larger volume-changer 81' (see FIG. 4), this will decrease the air consumption even more for a higher operating pressure. The method for lowering air consumption and the way it is accomplished in an easy and inexpensive manner. The recess 80 described above can be run empty or with different sizes of lightweight materials to adjust the air consumption. There is no change of any major components and the volume-changers are not subject to any wear and can be easily changed.

Figure 4:
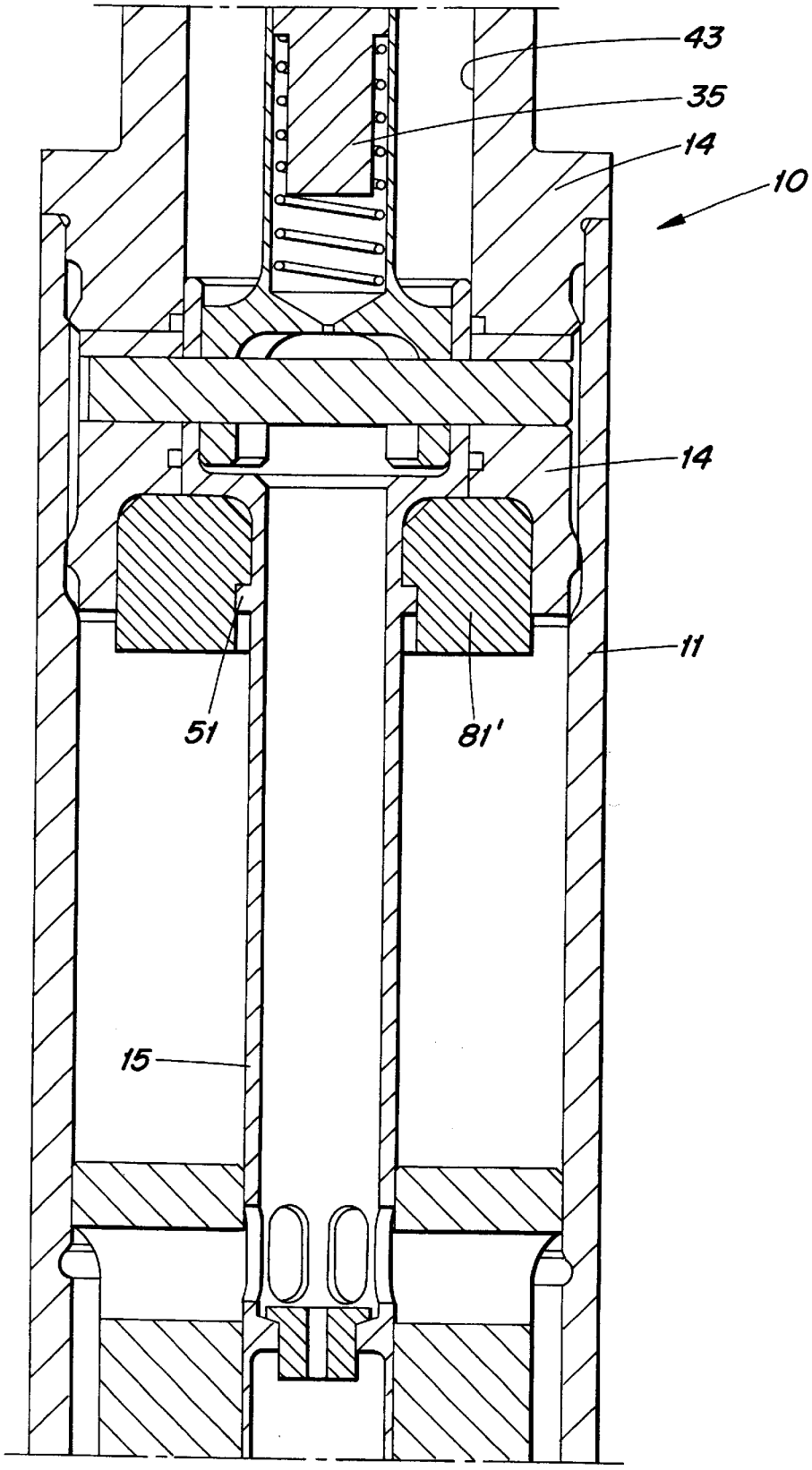
FIG. 4 shows a view similar to FIG. 2 but in a low air consumption mode.

Volume-changers tested in the hammer produced the following results:

The high volume hammer as shown in FIG. 2 gave a pressure 350 psi at an air flow of 1095 scfm. An intermediate volume hammer as shown in FIG. 3 gave a pressure 350 psi at an air flow of 974 scfm. A low volume hammer as shown in FIG. 4 gave a pressure 350 psi at an air flow of 883 scfm.

As can be seen, the simple change of an inexpensive plastic or other suitable lightweight material can have a dramatic affect on the air consumption of the hammer and still maintain the pressure. The volume-changer will be very inexpensive to manufacture and be inexpensive to install. Furthermore the hammer will offer wide flexibility and the driller/contractor can make use of maximum efficiency to maintain productivity. The air consumption adjustment does not involve replacing any wear items.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A down-the-hole percussive hammer rock drill, comprising:

a generally cylindrical casing carrying a drill bit;

a piston mounted in said casing for reciprocation in a longitudinal direction to repeatedly impart impacts to the drill bit;

a hollow top sub mounted at a rear portion of the casing; the top sub comprising a front face facing towards the piston;

a hollow feed tube mounted to the top sub and extending forwardly along a longitudinal center axis of the casing and defining a center passage adapted to conduct pressurized air;

the piston including an axial through-hole slidably receiving the feed tube, wherein the piston is slidable in a space disposed in front of the front face;

the front face and the feed tube together forming a recess which opens toward the piston, and a volume-changer removably insertable into the recess to vary a volume of the space and a pressure at which the piston operates.

2. The hammer according to claim 1 wherein a portion of the feed tube disposed in the recess includes a radially outwardly projecting rib, the volume-changer including a plurality of members each having a slit for receiving the rib.

3. The hammer according to claim 2 wherein each member of the volume-changer is of generally semi-cylindrical shape.

4. The hammer according to claim 1 wherein the volume-changer has a different volume than the recess.

5. The hammer according to claim 1 wherein the volume-changer has a greater volume than the recess.

6. A top sub assembly adapted for use in a down-the-hole percussive hammer for rock drilling, the top sub assembly comprising:

a hollow top sub comprising a front face adapted to face towards a piston;

a hollow feed tube mounted to the top sub and extending forwardly from the front face along a longitudinal center axis of the casing and defining a center passage adapted to conduct pressurized air;

the front face and the feed tube together forming a recess, and a volume-changer removably insertable into the recess to vary a pressure at which the piston operates.

7. The top sub assembly according to claim 6 wherein a portion of the feed tube disposed in the recess includes a radially outwardly projecting rib, the volume-changer including a plurality of members each having a slit for receiving the rib.

8. The top sub assembly according to claim 7 wherein each member of the volume-changer is of generally semi-cylindrical shape.

9. The top sub assembly according to claim 6 wherein the volume-changer has a different volume than the recess.

10. The top sub assembly according to claim 6 wherein the volume-changer has a greater volume than the recess.

11. The top sub assembly according to claim 6 wherein the top sub includes a valve disposed therein and spring biased to a closed state in a direction away from the recess.

12. The top sub assembly according to claim 11 wherein the top sub includes an external screw thread adapted for mounting the top sub.

13. A method of varying a pressure at which a down-the-hole percussive hammer operates, the hammer comprising:

a generally cylindrical casing adapted to carry a drill bit;

a piston mounted in said casing for reciprocation in a longitudinal direction to repeatedly strike the drill bit;

a top sub mounted at a rear portion of the casing; the top sub comprising a front face facing towards the piston;

a hollow feed tube mounted to the top sub and extending forwardly along a longitudinal center axis of the casing and defining a center passage adapted to conduct pressurized air;

the piston including an axial through-hole slidably receiving the feed tube, wherein the piston is slidable in a space disposed in front of the front face; and the front face and the feed tube together forming a recess opening toward the piston;

the method comprising the step of inserting a removable volume-changer into the recess to vary a volume of the space and a pressure at which the piston operates.

14. The method according to claim 13 wherein the inserting step comprises inserting a volume-changer having a different volume than the recess.

15. The method according to claim 13 wherein the inserting step comprises inserting a volume-changer having a greater volume than the recess.

* * * * *